United States Patent [19]

Mironenko et al.

[11] Patent Number: 4,758,698

[45] Date of Patent: Jul. 19, 1988

[54] MICROSWITCH

[75] Inventors: Vyacheslav G. Mironenko, Moscow; Alexandr P. Poltorak, Donetsk; Vitaly I. Schutsky, Moscow; Vladimir A. Kosovtsev, Kharkov; Fedor P. Chaly, Kharkov; Vladislav F. Zagubeljuk, Kharkov; Nikolai I. Filatov, Dagestanskaya, all of U.S.S.R.

[73] Assignee: Vsesojuzny nauchno-issledovatelsky et al., Donetsk, U.S.S.R.

[21] Appl. No.: 852,945

[22] PCT Filed: Jul. 31, 1986

[86] PCT No.: PCT/SU84/00045

§ 371 Date: Mar. 27, 1986

§ 102(e) Date: Mar. 27, 1986

[87] PCT Pub. No.: WO86/01030

PCT Pub. Date: Feb. 13, 1986

[51] Int. Cl.[4] ..... H01H 15/18

[52] U.S. Cl. ..... 200/67 DB; 200/76

[58] Field of Search ..... 200/67 DB, 76

[56] References Cited

U.S. PATENT DOCUMENTS

| | | | |
|---|---|---|---|
| 2,125,432 | 8/1938 | Du Brie | 200/76 |
| 2,791,656 | 5/1957 | Dehn et al. | 200/67 D |
| 3,764,761 | 10/1973 | Poltorak et al. | 200/76 |
| 4,086,455 | 4/1978 | Takahashi | 200/76 |

FOREIGN PATENT DOCUMENTS

| | | | |
|---|---|---|---|
| 2052610 | 5/1972 | Fed. Rep. of Germany | 200/76 |
| 1344714 | 10/1963 | France | 200/76 |
| 587515 | 1/1978 | U.S.S.R. | 200/76 |

*Primary Examiner*—Renee S. Luebke

*Attorney, Agent, or Firm*—Lilling & Greenspan

[57] ABSTRACT

A microswitch includes a base (1), fixed contacts (2) and movable contacts (3). The movable contacts (3) are connected to a drive member (4) by way of a mechanism for switching the movable contacts having at least two assemblies (7) disposed in symmetry relative to the axis of the drive member (4). Each of the assemblies (7) includes a lever (8) and a spring (9) the outer ends (15,16) of which are interconnected to be capable of swinging angularly relative to each other. One element (8) of these two elements (8, 9) of the assemblies (7) is connected by its inner end (10) to the drive member (4) for swinging angularly relative thereto. Other respective elements (9) of each assembly (7) on which the movable contacts (3) are secured have the form of an integral resilient part (12) the central portion of which has secured thereto the movable contacts (3). The resilient part (12) at the portions thereof between the attachment points thereon of the movable contacts (3) and its outer ends (15) define in each assembly (7) of the mechanism for switching the movable contacts resilient elements (9) arranged in symmetry relative to the axis of the drive member (4) at an angle to each other in any possible position of the drive member (4). Also provided are stop elements (17) for restricting the movement of the outer ends of the assemblies of the mechanism for switching the movable contacts. The attachment points of the movable contacts (3) on the resilient part (12) are located between the stop elements (17) at equal distances therefrom.

5 Claims, 11 Drawing Sheets

82
80
87
88
92
83
88
92
87

81
81
89
90

77
89
90
85
78
86

73
84
75

73
72
74

101
102
105

103
104
106
95

105
101
102
94
104

99

96
97
75
73
74

MICROSWITCH

BACKGROUND OF THE INVENTION

1. Field of the Invention

This invention relates generally to electrical engineering, and more particularly to microswitches.

2. Description of the Prior Art

The process of contact switching in limit switches is normally induced by the action of a movable cam on the drive element of the switch. At low speeds of operation of the machine cam member and at a speed of contact switching dependent on the speed of travel of the cam, as is the case with direct action switches, the interval between the initial engagement of contacts under load and the point when a suffient contact pressure is developed between the contacts is relatively lengthy. The prolonged closed position of the contacts under electric load accompanied by insufficient contact pressure, as well as slow switching action of the contacts may cause numerous emergencies, such as fusing, burning and welding of contacts.

In order to obviate the aforedescribed contact damage at low speeds of travel of the movable cam, use is generally made of microswitches provided with means for accelerating the speed of contact switching.

There is known a microswitch (cf., e.g. U.S. Pat. No. 2,791,656) comprising a base, fixed contacts secured on the base, and movable contacts connectable with the fixed contacts. Connected to the movable contacts is a drive member, this connection being executed by means of a mechanism for switching the movable contacts in the form of a resilient strip. Immediately in the central portion of the resilient strip there are arranged the movable contacts. At the portions between the attachment points of the movable contacts and their outer ends connected to the drive member the resilient strip has two resilient elements disposed symmetrically relative to the axis of the drive member at an angle to each other for swinging angularly relative to each other. This microswitch is simple to construct and has relatively small dimensions.

Operation of this microswitch is characterized in that during the movement of the drive member the ends of the resilient elements of the mechanism for switching the movable contacts connected therewith tend to be displaced. Therewith, the resilient elements change their position relative to the movable contacts, whereas the contact pressure varies depending on the speed of travel of the drive member from its nominal value to the minimum. Upon the drive member reaching the movable contacts the resilient elements assume substantially horizontal position, while the contact pressure drops practically to zero. A slow or reverse movement of the drive member may result in that the contact pressure may be close to zero for a considerable length of time, which in turn may cause failure of the microswitch.

When operation of the aforedescribed microswitch is accompanied by vibrations or impacts, even negligeable displacements of the drive member and movable contacts upset the position of the spring elements relative to the movable contacts and lead, accordingly, to minimized contact pressure.

When the drive member assumes a position close to contact making or breaking, the fully deformed resilient strip is almost horizontal, whereas its central portion is pressed by the movable contacts to the fixed contacts with a minimal force to result in unstable position of the resilient strip. Even small vibrations or impact forces acting on the microswitch in this position of the drive member may cause accidental switching of the movable contacts when the drive member is short of the position for contact making or breaking, or triggering. For this reason, the above microswitch fails to provide a reliable triggering accuracy (repeatability of triggering points) when the drive member moves slowly or reversed, or when the microswitch is subjected to vibrations and shocks.

Such a low accuracy of the microswitch and insufficiently reliable operation thereof during slow or reversed movement of the drive member accompanied by vibrations and impacts exerted on the microswitch limits the field of its application.

There is also known a microswitch (cf., U.S. Pat. No. 2,125,432) comprising a base, fixed contacts secured on the base, and movable contacts connectable with the fixed contacts. A drive member is linked with the movable contacts by way of a mechanism for switching the movable contacts defined by two springs disposed symmetrically relative to the axis of the drive member. Outer ends of the springs are connected to the drive member for angular swing relative thereto. Inner ends of the springs are connected to the contact holder on which the movable contacts are secured. The positioning of the movable contacts on the contact holder outside the mechanism for switching the movable contacts makes it possible to operate the microswitch under higher current loads.

However, this modified form of a microswitch also fails to assure reliable operation when the drive member thereof is moved slowly or reversed, or when the microswitch is subjected to vibrations and impacts due to that the position of the springs relative to the fact the movable contacts tends to change before the triggering point.

There is also widely known a microswitch (cf., e.g., U.S. Pat. No. 3,764,761) comprising a base, fixed contacts secured on the base, and movable contacts connectable with the fixed contacts. Connected to the movable contacts is a drive member, this drive member being thus connected by means of a mechanism for switching the movable contacts having at least two assemblies disposed symmetrically relative to the axis of the drive member. Each of the assemblies is comprised of a lever and a spring.

Outer ends of the levers and springs are interconnected to be capable of swinging angularly relative to each other. The outer ends of the levers are thrust against stop elements arranged on the base. Inner ends of the springs are connected to the drive member for swinging angularly relative thereto. Inner ends of the levers carrying the movable contacts are interconnected for angular swing relative to the axis of the drive member. The distance between the points of contact of the outer ends of the levers with the stop elements is greater than the distance between the attachment points of the movable contacts on the inner ends of the levers.

In the microswitch described heretofore the movement of the drive member to the point of triggering practically does not cause a change in the relative angular position of the levers on which the movable contacts are secured. Therefore, the contact pressure is not dependent on the speed of movement of the drive member or its position.

Further, small displacements of the drive member or movable contacts under the action of the forces of vibration or impact result in an increase in the contact pressure, whereby the above known microswitch is sufficiently resistant to vibrations and impacts.

However, this microswitch is difficult to construct, is bulky and has too many parts. The length of such a microswitch is determined by the length of two levers and the mechanism for switching the movable contacts interposed between the levers, whereas the width of the microswitch is determined by the width of the contact levers and two dimensions of the flat lateral springs of significant width.

SUMMARY OF THE INVENTION

This invention is therefore directed toward the provision of a microswitch having such a structural arrangement of a mechanism for switching the movable contacts that enables reduction of the size of the microswitch and make it resistant to vibrations and impacts, as well as to assure a greater reliability and accurracy of triggering.

The aim of the invention is attained by a microswitch comprising a base, fixed contacts secured on the base, movable contacts connectable with the fixed contacts, a drive member connected to the movable contacts by way of a mechanism for switching the movable contacts having at least two assemblies disposed symmetrically relative to the axis of the drive member, each of the assemblies including a lever and a spring the outer ends of which are interconnected for swinging angularly relative to each other, one of which is connected by its inner end to the drive member to be capable of swinging angularly relative thereto, other respective elements of the assemblies on which the movable contacts are secured being connected to be capable of swinging angularly relative to the axis of the drive member, also provided are stop elements for restricting the movement of the outer ends of the mechanism for switching the movable contacts arranged on the base and engageable with the outer ends of some of the respective elements of the assemblies of the mechanism for switching the movable contacts, the distance between the contact points of the outer ends of the assemblies of the mechanism for switching the movable contacts with the stop elements being greater than the distance between the inner ends of the respective elements of the assemblies of the mechanism for switching the movable contacts. According to the invention, the respective elements of the assemblies of the mechanism for switching the movable contacts on which the movable contacts are secured are fashioned as an integral resilient part in the central portion of which the movable contacts are secured so that the resilient part at the portions between the attachment points thereon of the movable contacts and its outer ends defines in each of the assemblies of the mechanism for switching the movable contacts resilient elements positioned symmetrically relative to the axis of the drive member at an angle to each other in any position of the drive member, whereas the attachment points of the movable contacts on the resilient part are arranged between the stop elements at equal distances therefrom.

The object of the invention is also attained by a microswitch comprising a base, fixed contacts secured on the base, Contact holders movably secured on the base and disposed symmetrically relative to the fixed contacts, movable contacts secured on the contact holders and connectable with the fixed contacts, a drive member connected to the movable contacts by way of a mechanism for swwitching the movable contacts having at least two assemblies arranged in symmetry relative to the axis of the drive member, each of the assemblies including a lever and a spring outer ends of which are interconnected for angular swinging relative to each other, one of the assemblies being connected by its inner end to the drive member for angular swing relative thereto, other respective elements of the assemblies being detachably connected to the contact holder for swinging angularly relative to the axis of the drive member, also being provided are stop elements for restricting the movement of the outer ends of the assemblies of the mechanism for switching the movable contacts arranged on the base and engageable with outer ends of some of the respective elements of the assemblies of the mechanism for switching the movable contacts, the distance between the contact points of the outer ends of the assemblies of the mechanism for switching the movable contacts with the stop elements being greater than the distance between the inner ends of the respective elements of the assemblies of the mechanism for switching the movable contacts. According to the invention, the respective elements of the assemblies of the mechanism for switching the movable contacts connected to the contact holder are fashioned as an integral resilient part and connected by their central portion to the contact holder by means of attachment elements provided on at least one of such parts so that the resilient part at the portions between the connection point thereof with the contact holder and its outer ends defines in each assembly of the mechanism for switching the movable contacts resilient elements disposed symmetrically relative to the axis of the drive member at an angle to each other in any position of the drive member, the connection points of the resilient part with the contact holder being disposed between the stop elements at equal distances therefrom.

Preferably, for reducing the size of the microswitch in terms of its width the resilient part of the mechanism for switching the movable contacts has the form of a strip.

Preferably, for reducing the size of the microswitch in terms of its length the resilient part of the mechanism for switching the movable contacts is fashioned as a frame, the movable contacts being secured in the central portion of each of the sides thereof.

The proposed invention makes it possible to produce a small-size, structurally simple microswitch ensuring invariable contact pressure during the movement of the drive member to a triggering position. The invention also offers high resistance of the microswitch to vibrations and impacts, reliability in operation and sufficient triggering accuracy.

BRIEF DESCRIPTION OF THE DRAWINGS

The invention will now be described in greater detail with reference to various preferred embodiments thereof taken in conjunction with the accompanying drawings, in which.

DESCRIPTION OF THE PREFERRED EMBODIMENTS

Figure 1:
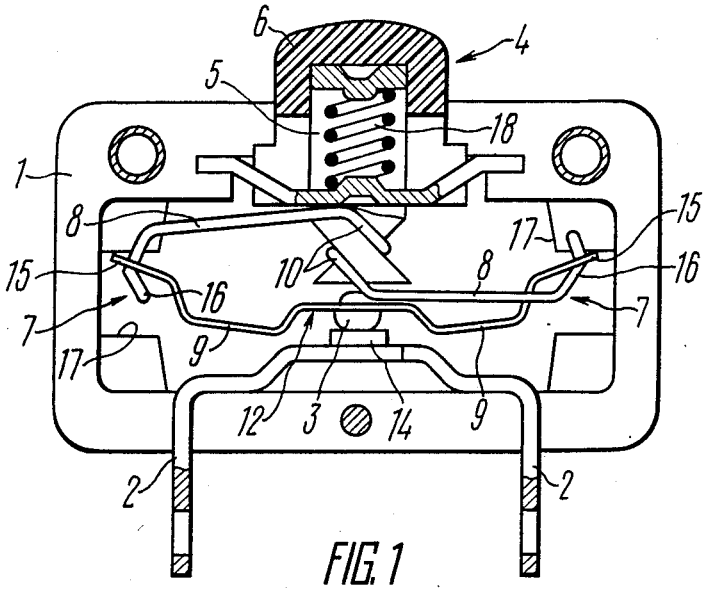
FIG. 1 is a general view of a first preferred embodiment of a microswitch according to the invention.

A microswitch comprises a base 1 (FIGS. 1 and 2) of an electrically insulating material, fixed contacts 2 secured on the base 1, and movable contacts 3 connectable with the fixed contacts 2. A drive member 4 includes a bracket 5 (FIG. 3*a*) and a pusher 6 (FIGS. 1 and 3), in the form of a cap said pusher being made from an electrically insulating material. The drive member 4 influences movable contacts 3 by way of a mechanism for switching the movable contacts. The mechanism for switching the movable contacts has two assemblies indicated at 7 and disposed symmetrically relative to the axis of the drive member 4. Each assembly 7 is comprised of a lever 8 (FIG. 3) fashioned as a frame element made of wire, and a spring 9. The levers 8 are connected by their inner ends 10 to knife supports 11 (FIG. 3*a*) of the bracket 5 of the drive 4 (FIG. 1) to be capable of angular swing relative thereto. The springs 9 (FIG. 3*b*) are interconnected to form an integral resilient part 12 on which in its central portion there are secured the fixed contacts 3 (FIGS. 1, 2 and 3) having locations for coming into contact with contact points 14 (FIG. 3*c*) of the fixed contacts 2. The springs 9 (FIGS. 1 and 2) are interconnected to be capable of angular swing relative to the axis of the drive member 4 and accommodated at an angle relative to each other in the initial and switched positions, as well as in any other position of the drive member 4, except positions for direct or return operations of the microswitch. Outer ends 15 of the springs 9 are connected to outer ends 16 of the levers 8 to swing angularly relative to each other.

The integral part 12 at portions thereof between the attachment thereto of the movable contacts 3 and its outer ends 15 define in each of the units 7 of the mechanism for switching the movable contacts resilient elements (viz., springs 9), which are disposed symmetrically relative to the axis of the drive member 4 at an angle to each other in any position occupied by the drive member 4. Stop elements 17 are provided on the base 1 to confine the movement of the outer ends of the assemblies of the mechanism for switching the movable contacts against which the outer ends 15 of the springs 9 are thrust. The distance between the points of contact of the outer ends 15 of the springs 9 of the assembly 7 with the stop elements 17 is greater than the distance between the inner ends 10 of the levers 8 of the assembly 7 of the mechanism for switching the movable contacts.

Attachments of the movable contacts 3 to the resilient unit 12 are located between the stop elements 17 equidistantly therefrom.

The microswitch also comprises a return spring 18 in contact with the bracket 5 of the drive member 4.

The length of the microswitch in this modified form is determined by the length of the spring 9 and the dimensions of the movable contact 3, whereas its width is determined by the width of the resilient unit 12 and to some extent by the minimal thickness of the levers 8 and the bracket 5 of the drive member 4. Such an arrangement of the microswitch ensures its minimized dimensions in terms of width and length.

Figure 4:
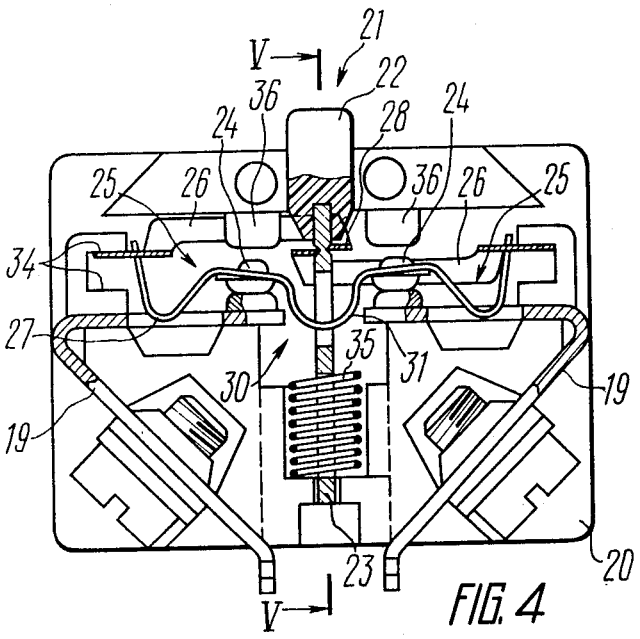
FIG. 4 is a general view of a second alternative modification of the microswitch according to the invention.
Figure 5:
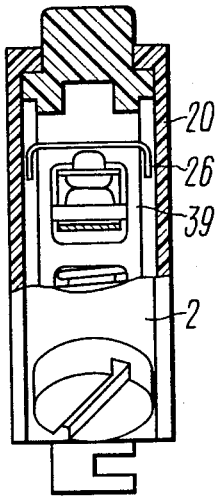
FIG. 5 is a section taken along the line V—V in FIG. 4 of the second modification of the microswitch according to the invention.
Figures 7A, 7B, 7C, 7D, 7E, 7F:
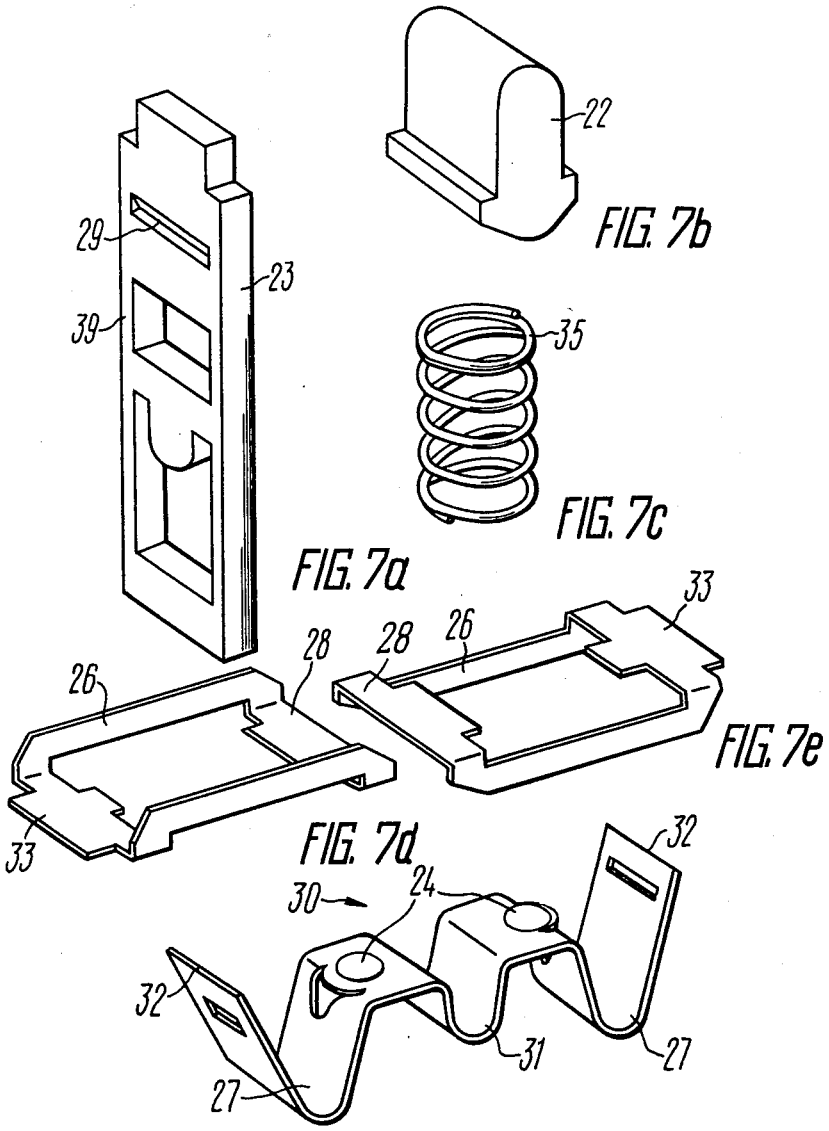
FIGS. 7 (*a, b, c, d, e,* and *f*) is an axonometric view of the resilient part of the mechanism for switching the movable contacts and other elements of the microswitch according to the invention.

With reference to FIGS. 4 and 5, there is shown another modification of the proposed microswitch preferable when it is necessary to minimize the width thereof, this microswitch having fixed break contacts 19 secured on a base 20 (FIG. 5) fabricated from an electrically insulating material. A drive member 21 (FIG. 4) is defined by a pusher 22 (FIG. 7*b*) in the form of a cap made from an insulating material and plate 23 (FIG. 7*a*). The drive member 21 (FIG. 4) is connected to movable contacts 24 by way of a mechanism for switching these contacts having two assemblies 25 disposed symmetrically relative to the axis of the drive member 21. Each assembly 25 is comprise of a lever 26 (FIGS. 7 *c, d* and *e*) in the form of a frame of a thin-wall material, and a spring 27. The levers 26 (FIG. 4) are connected by their inner ends 28 to knife supports 29 (FIG. 7*a*) of the plate 23 (FIG. 4) of the drive member 21 to be capable of angular swing relative thereto. The springs 27 are interconnected to form a single integral unit 30 (FIG. 7*f*) the central portion of which has an arch 31, and the ends of which are provided with the movable contacts 24 (FIG. 4). The springs 27 are interconnected so as to be capable of angular swing relative to the axis of the drive member 21, and are disposed at an angle to each other in the initial and switched positions, as well as in any other positions of the drive member 21, except in a position for direct or return operations of the microswitch.

Outer ends 32 (FIG. 7*f*) of the springs 27 are connected to outer ends 33 of the levers 26 for angular swing relative to each other. In this fashion the resilient unit 30 at the portions between the attachments thereto of the movable contacts 24 and the outer ends 32 defines in each assembly 25 of the mechanism for switching the movable contacts resilient elements (viz., springs 27) arranged in symmetry relative to the axis of the drive member 4 and at an angle to each other in any position of the drive member 4.

Referring again to FIG. 4, the base 20 is provided with stop elements 34 to limit the movement of the outer ends 33 of the levers 26 of the assemblies 25 of the mechanism for switching the movable contacts into which these outer ends 33 are thrust.

The distance between the locations where the outer ends 33 of the levers 26 are brought into contact with the stop elements 34 is greater than the distance between the inner ends 28 of the levers 26.

The attachment points of the movable contacts 24 on the resilient unit 30 are located between the stop elements 34 equidistantly therefrom.

The proposed microswitch is also provided with a return spring 35 in contact with the plate 23 of the drive member 21.

Stops 36 fabricated from an electrically insulating material are further provided on the base 20 for limiting the travel of the movable contacts 24 in the switched position.

A third modified form of the microswitch according to the inventions is proposed for embodying the switch with break contacts. In this instance (FIG. 6) the microswitch has fixed contacts 37 with contact points 38 in the upper portion of the base 20, the stops 36 being attached in the lower portion of the base 20.

Figure 6:
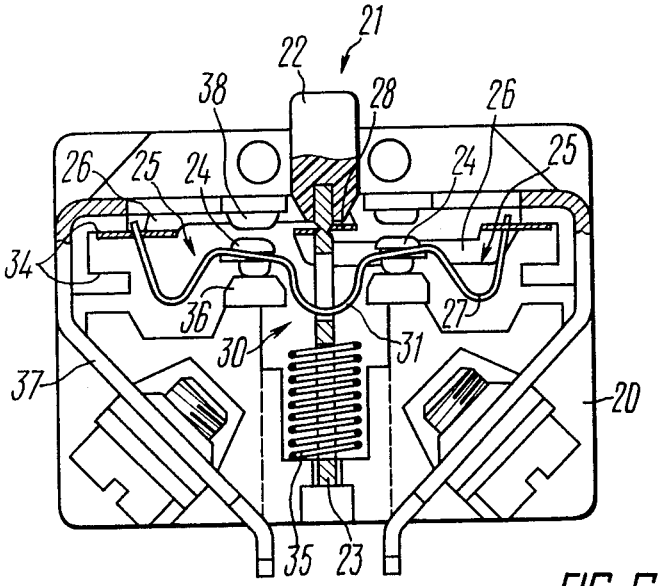
FIG. 6 is a general view of a third modified form of the microswitch according to the invention.

The width of the microswitch in the third embodiment thereof is determined by the width of the resilient unit 30 (FIGS. 4 and 6) commensurable with the diameter of the movable contact 24, the thickness of bridges 39 (FIG. 5) of the plate 23, and the thickness of the sheet material of the side portions of the lever 26 (FIGS. 4 and 6).

Such an arrangement of the microswitch makes it possible to minimize its width.

Figure 8:
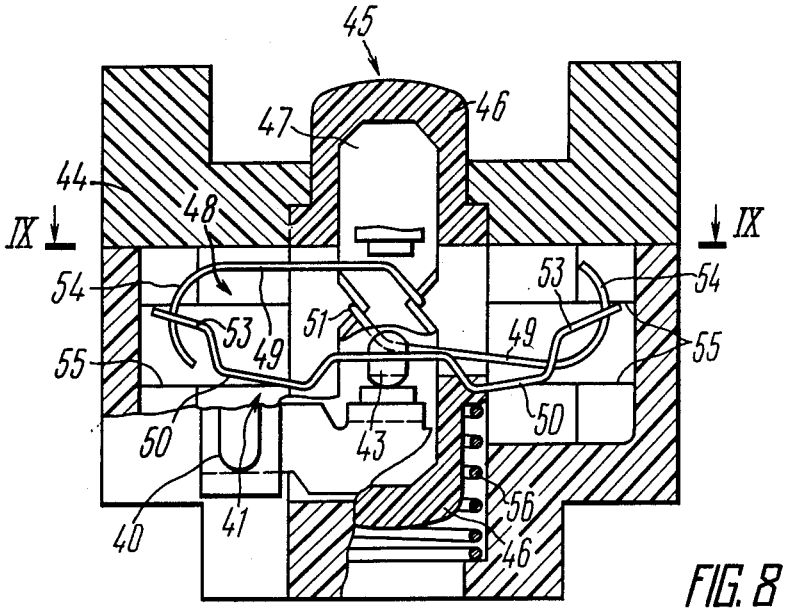
FIG. 8 is a general view of fourth modification of the proposed microswitch.
Figure 9:
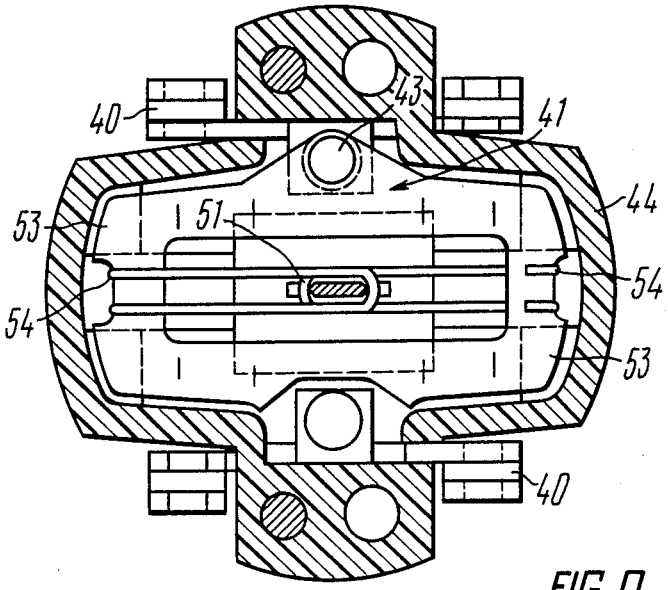
FIG. 9 is a section taken along the line IX—IX in FIG. 8 of the fourth modification of the microswitch according to the invention.
Figure 10A:
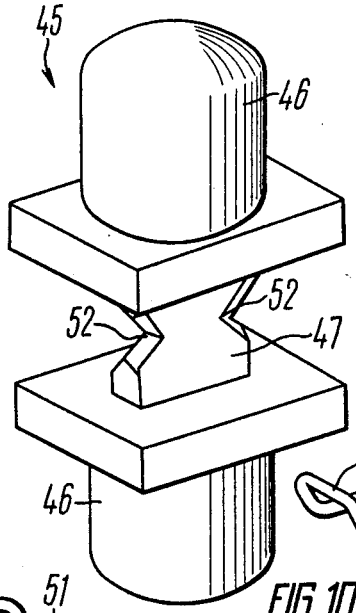
FIGS. 10 (*a, b, c,* and *d*) is an axonometric view of the mechanism for switching the movable contacts and other elements of the fourth modification of the microswitch according to the invention.
Figure 10B:
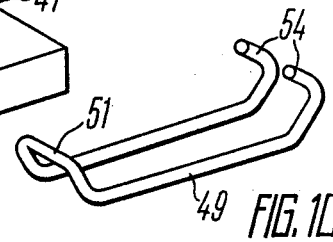
Figure 10C:
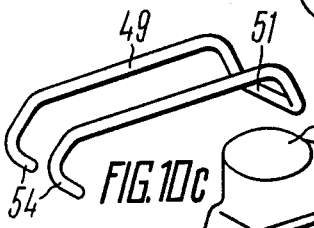
Figure 10D:
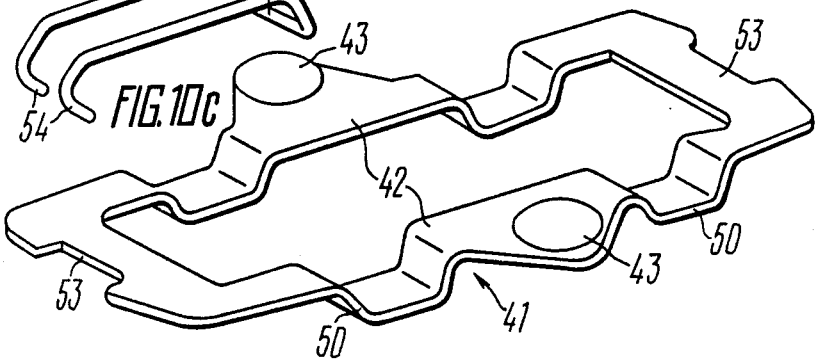

With reference to FIGS. 8 and 9, there is shown a fourth modification of the proposed microswitch of small dimensions with side connections to current leads, this modification having fixed contacts as indicated at 40. In this case the mechanism for switching the movable contacts has a resilient frame-like part 41, the central portion of each of its sides 42 (FIG. 10*d*) having attached thereto movable contacts 43. The fixed contacts (FIG. 8) are secured on a base 44 fabricated from an electrically insulating material. A drive member 45 is defined by pushers 46 (FIGS. 8 to 10) in the form of two caps of an electrically insulating material and by a plate 47.

The drive member 45 is connected to the movable contacts 43 through a mechanism for switching the movable contacts having two assemblies 48 disposed in symmetry relative to the axis of the drive member 45. Each assembly 48 is comprised of a lever 49 fashioned as a C-shaped wire bracket, and a spring 50. The levers 49 are connected by their inner ends 51 to knife supports 52 (FIG. 10*a*) of the plate 47 of the drive member 45 (FIG. 8) to be capable of angular swing relative thereto. Outer ends 53 of the springs 50 are connected to outer ends 54 of the levers 49 for angular swinging relative to each other.

The resilient part 41 of the mechanism for switching the movable contacts defines at the portions between the attachment points of the movable contacts 43 thereto and the outer ends 53 in each of the assemblies 48 of the mechanism for switching the movable contacts resilient units (viz., springs 50), which are connected so as to be capable of angular swing relative to the axis of the drive member and disposed symmetrically relative to the axis of the drive member 45 at an angle to each other in the initial and switched positions, as well as in any other position of the drive member 45, except in the positions for direct or return operations of the microswitch.

The base 44 has stop elements 55 for limiting the movement of the outer ends of the assemblies of the mechanism for switching the movable contacts, the outer ends 53 of the springs 50 being thrust against these stop elements 55. The distance between the contact points of the outer ends 53 of the springs 50 with the stop elements 55 is greater than the distance between the outer ends 51 of the levers 49. The attachment points of the movable contacts 43 on the resilient part 41 of the mechanism for switching the movable contacts are located between the stop elements 55 equidistantly therefrom.

The microswitch is also provided with a return spring 56 engageable with the cap 46 of the drive member 45.

Figure 11:
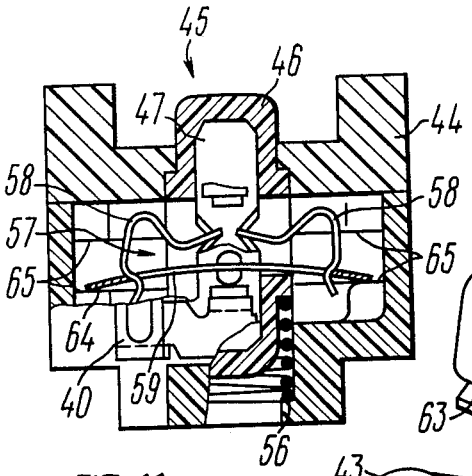
FIG. 11 is a general view of a fifth modified form of the microswitch according to the invention.
Figure 12A:
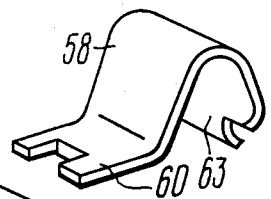
FIGS. 12 (*a, b,* and *c*) is an axonometric view of the resilient part of the mechanism for switching the movable contacts and other elements of a fifth alternative modification of the microswitch according to the invention.
Figure 12B:
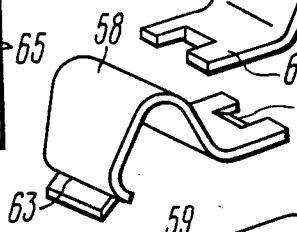
Figure 12C:
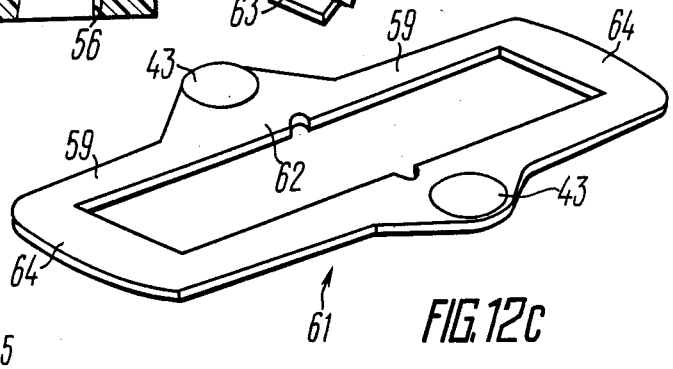

In a fifth modified form of the proposed microswitch illustrated in FIGS. 11 and 12 the drive member 45 is connected to the movable contacts 43 through a mechanism for switching the movable contacts which has two assemblies 57 arranged in symmetry to the axis of the drive member 45, each of these assemblies being comprised of a spring 58 and a lever 59. The springs 58 are connected by their inner ends 60 to the plate 47 of the drive member 45 for angular swing relative thereto. The levers 59 are fashioned as an integral resilient unit or part 61 in the form of a frame, the central portion of each side 62 (FIG. 12*c*) thereof being provided with the movable contact 43. Outer ends 63 of the springs 58 are connected to outer ends 64 of the levers 59 of the assemblies 57 of the mechanism for switching the movable contacts to thrust against stop elements 65 (FIG. 11) preventing the movement of the outer ends of the assemblies of the mechanism for switching the movable contacts.

The resilient part 61 define at the portions between the points of attachment thereto of the movable contacts 43 and the outer ends 64 thereof in each of the assembly 57 of the mechanism for switching the movable contacts resilient elements (viz., levers 59), which are arranged in symmetry relative to the axis of the drive member 45 at an angle to each other at any position of the drive member 45. The attachment points of the movable contacts 43 of the resilient part 61 are disposed between the stop elements 65 at equal distances therefrom.

Figure 13:
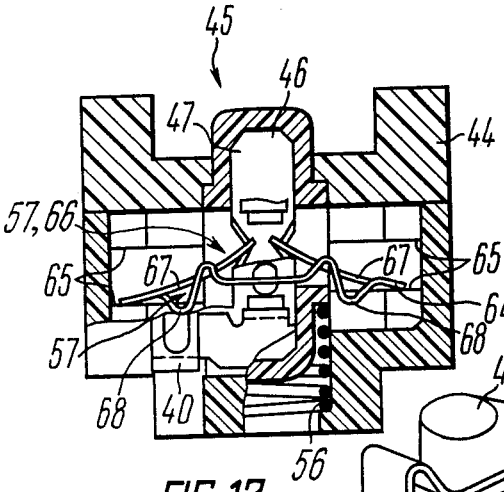
FIG. 13 is a general view of a sixth alternative modified form of the microswitch according to the invention.
Figure 14:
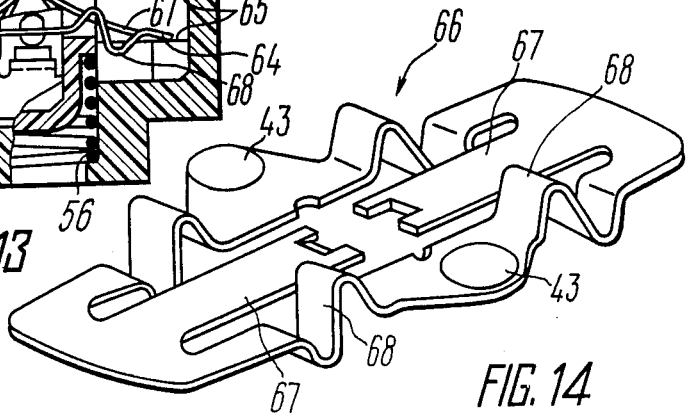
FIG. 14 is an axonometric view of a resilient part of the mechanism for switching the movable contacts of the sixth modification of the proposed microswitch.

A sixth alternative modification of the microswitch is possible in which all the elements of the assemblies 57 (FIG. 13) of the mechanism for switching the movable contacts are fashioned as a single resilient part 66 (FIG. 14) comprising levers 67 and springs 68. The resilient part 66 of the mechanism for switching the movable contacts defines at the portions between the attachment points thereon of the movable contacts 43 and its outer ends 64 in each assembly 57 of the mechanism for switching the movable contacts resilient elements (viz., levers 67 and springs 68) arranged symmetrically relative to the axis of the drive member 45 at an angle to each other in any position of the drive member 45. The attachment points of the movable contacts 43 on the resilient part 66 are disposed between the stops 65 limiting the movement of the outer ends of the assemblies of the mechanism for switching the movable contacts at equal distances therefrom.

Another, particularly the seventh, modification of the proposed microswitch is adaptable for operation at high current loads, in which the movable contacts are accommodated outside the space where the mechanism for switching the movable contacts is arranged.

Figure 15:
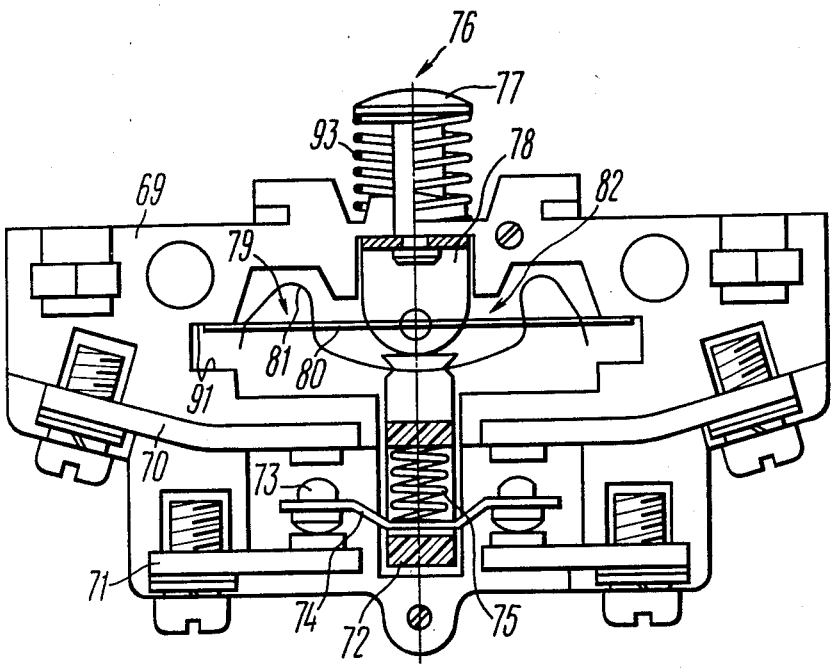
FIG. 15 illustrates a general view of a seventh modification of the microswitch according to the invention.

This modification of the microswitch comprises a base 69 (FIG. 15), fixed contacts 70 and 71 secured on a base 69, a contact holder 72 secured to the base 69 to be capable of movement and disposed symmetrically relative to the fixed contacts 70, 71, movable contacts 73 secured on a contact bridge 74, which in turn is attached to the contact holder 72 by means of a spring 75.

A drive member 76 in the form of a pusher 77 and bracket 78 is connected to the contact holder 72 by way of a mechanism for switching the movable contacts, which includes two assemblies 79 arranged in symmetry relative to the axis of the drive element 76. Each assembly 79 of the mechanism for switching the movable contacts is comprised of a lever 80 and a spring 81.

Figures 16A, 16B, 16C, 16D, 16E:
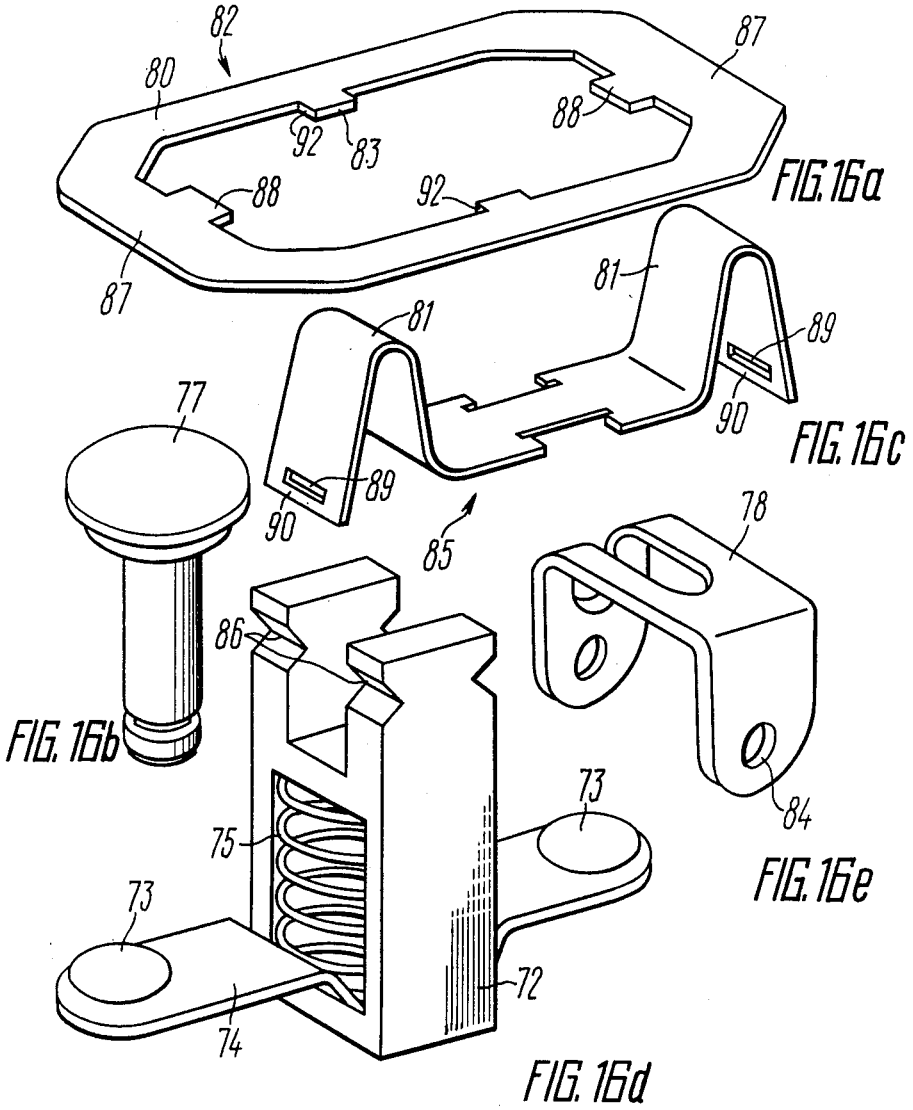
FIGS. 16 (*a, b, c, d* and *e*) is an axonometric view of a resilient part of the mechanism for switching the movable contacts and other elements of the microswitch according to the invention.
Figure 17:
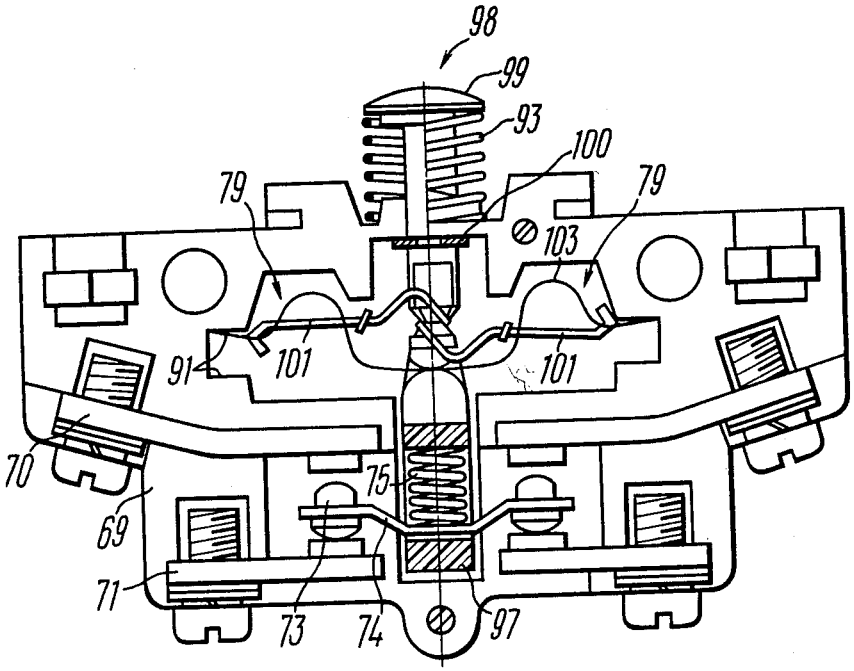
FIG. 17 is a general view of an eighth modified form of the microswitch according to the invention.

The levers 80 define an integral resilient part 82 (FIGS. 16 *a, b, c, d,* and *e*) in the form of a frame connected by projections 83 to holes 84 of the bracket 78 of the drive member 76.

The levers 80 are capable of angular swing relative to the bracket 78 of the drive member 75.

The springs 81 are interconnected for swinging angularly relative to each other, and form an integral resilient part 85 which is connected by its central portion to knife supports 86 of the contact holder 72. Outer ends 87 of the levers 80 are connected by projections 88 to holes 89 of outer ends 90 of the springs 81 for the lever 80 and spring 81 to be capable of swinging angularly relative to each other.

The resilient part 85 of the mechanism for switching the movable contacts at the portions between the attachment points thereof with the contact holder 72 and its outer ends 90 define in each assembly 79 of the mechanism for switching the movable contacts resilient elements (viz., springs 81) disposed symmetrically relative to the axis of the drive member 76 at an angle to each other in any position of the drive member 76.

The base 69 (FIG. 15) is provided with stop elements 91 for restricting the movement of the outer ends of the assemblies of the mechanism for switching the movable contacts against which the outer ends 87 of the levers 80 are thrust.

The distance between the contact points of the outer ends 87 of the levers 80 with the stop elements 91 is greater than the distance between the inner ends 92 of the levers 80 of the assemblies 79 of the mechanism for switching the movable contacts.

The attachment points of the resilient part 85 on the contact holder 72 are between the stop elements 91 equidistantly therefrom.

The drive member 76 is spring-loaded by means of a return spring 93.

The herein described embodiment of the microswitch is characterized by rather few parts of the mechanism for switching the movable contacts.

Yet another modification of the microswitch is possible, when it is required that the microswitch has to be vey narrow. In this instance, the mechanism for switching the movable contacts has a resilient element 94 in the form of a frame the central part of which is provided with projections 95 cooperating with slots 96 of a contact holder 97.

A drive member 98 is comprised of a pusher 99 secured on the base 69 by a washer 100 and spring-loaded by the spring 93.

Figures 18A, 18B, 18C, 18D, 18E:
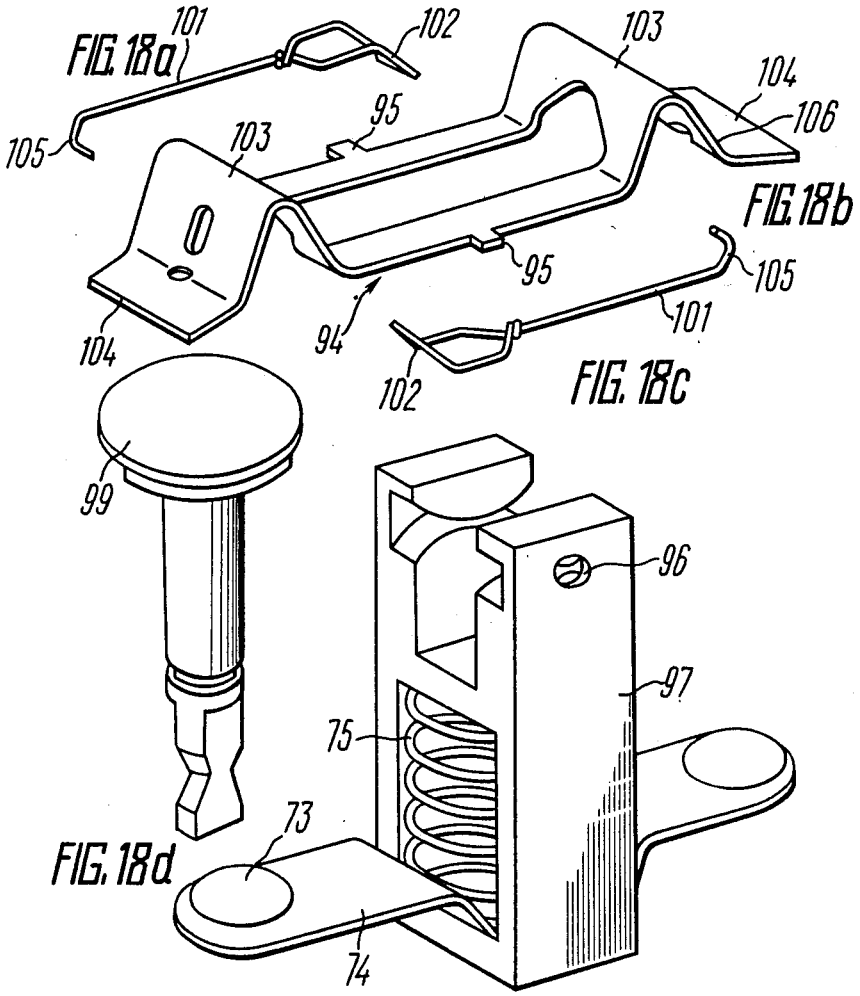
FIGS. 18 (*a, b, c, d* and *e*) is an axonometric view of the resilient part of the mechanism for switching the movable contacts and other elements of the eigth modification of the microswitch according to the invention.

Levers 101 (FIGS. 18*a, b, c, d* and *e*) have the form of wire brackets to be attached by their inner ends 102 to the pusher 96 of the drive member 98.

Springs 103 defining when connected to each other the integral resilient part 94 are connected by their outer ends 104 to outer ends 105 of the levers 101 hooked to holes 106.

The resilient part 94 of the mechanism for switching the movable contacts at the portions between attachment points thereof with the contact holder 97 and its outer ends 104 defines in each assembly 79 of the mechanism for switching the movable contacts resilient elements (springs 103) disposed symmetrically relative to the axis of the drive member 98 at an angle to each other in any position of the drive member 98. Attachment points of the resilient part 94 with the contact holder 97 are disposed between the stop elements 91 preventing the movement of the outer ends of the assemblies of the mechanism for switching the movable contacts against which the outer ends 105 of the levers 101 are thrust at equal distances therefrom.

The proposed microswitch operates in the following manner.

During the travel of the drive member 4 (FIG. 1) under the action of an external force applied thereto and when the ends 10 of the levers 8 cross the resilient part 12 the movable contacts 3 are switched. When the external force is relieved from the drive member 4, all the movable parts tend to assume the initial position under the action of the spring 15 (FIG. 1).

Figure 2:
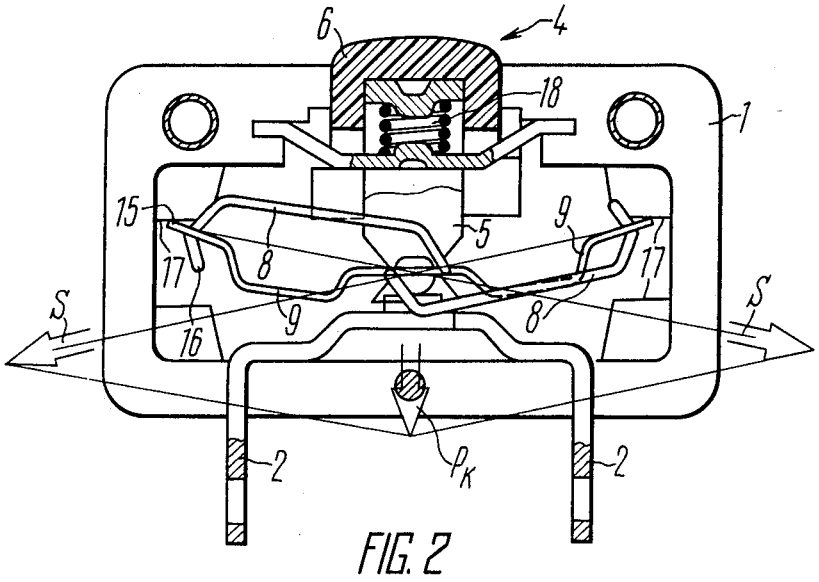
FIG. 2 is a view of the microswitch of FIG. 1 showing a second position of the drive member close to triggering.
Figures 3A, 3B, 3C, 3D:
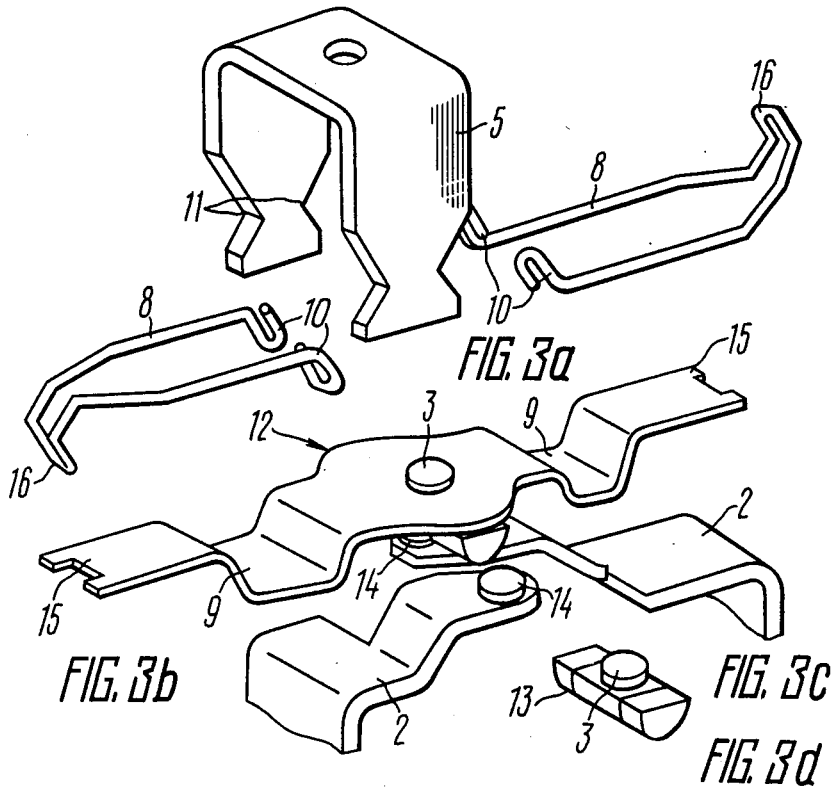
FIGS. 3 (*a, b, c,* and *d*) is an axonometric view of a resilient part of a mechanism for switching movable contacts and other elements of the first preferred embodiment of the proposed microswitch.

Because the springs 9 fail to change their position until the drive member 4 reaches operational position as seen in FIG. 2, the contact pressure Pc determined by the forces S of the springs 9 prior to the drive member 4 reaching its operational position remains practically invariable. When the drive member 4 or the movable contacts 3 are displaced under the action of vibration or impact, the springs 9 tend to deform, these springs 9 failing to change their position relative to the movable contacts 3 to result in an increase in the contact pressure.

By the drive member 4 attaining a position close to triggering, the resilient part 12 is pressed by its central portion to the fixed contacts 2 by a force of sufficient magnitude to enable even under vibrations or impacts stable trigger points of the microswitch.

Other alternative modifications of the proposed microswitch operate in a similar manner.

The proposed microswitch is characterized by reduced overall dimensions, which in turn enables to use it in apparatus (viz., push-button stations and limit switches) of smaller size.

The invention can find application in limit switches employed in automatic control systems, as well in signalling systems of electric drives of machines and mechanisms.

We claim:

1. A microswitch comprising a base; fixed contacts secured on said base; contact holders movably secured on said base and disposed symmetrically relative to said fixed contacts; movable contacts secured to said contact holders and operable with said fixed contacts; an actuating element comprising a drive member having an operative axis connected to the movable contacts by means of a movable contacts switching mechanism having at least two units arranged symmetrically relative to said axis of said actuating element, each of said units consisting of a lever and a spring having outer ends which, being the most remote from said axis of said actuating element, are interconnected at connection points in a manner providing for their reciprocal angular movement, like elements of said units each having inner ends having a distance from said axis of said actuating element less than the distance of the outer ends therefrom connected to said actuating element for angular movement relative thereto, other inner ends of like elements of said units carrying said movable contacts interconnected in a manner proving for their angular movement; limiters provided on said base for restricting displacement of the connection points of said lever characterized in that said contacts switching mechanism is connected at its central portion to said contact holder (72) by means of attachment elements (86) provided on at least one of such parts (72,85) so that said resilient part (85) at the portions between the connection points thereof with said contact holder (72) and its outer ends (90) defines resilient elements (81) disposed symmetrically relative to said axis of said drive member (76) at an angle to each other in any position of the drive member (76), the connection points of said resilient part (85) with the contact holder (72) being disposed between said stop elements (91) at equal distances therefrom, said integral resilient part of said mechanism for switching said movable contacts being a strip, said contact holders being secured in the central portion of said strip, said movable contacts being secured on a contact bridge which in turn is attached to said contact holder by means of said spring, said integral resilient part being connected by its central portion to knife suports of said contact holder.

2. A microswitch according to claim 1, characterized in that the movable contacts 73 are secured on a contact bridge 74, and the contact bridge 74 is attached to the contact holder by means of a spring 75 to be capable of self-adjustment.

3. A microswitch comprising a base, fixed contacts secured on said base; movable operable contacts; an actuating element having an operative axis connected to said movable contacts by means of a movable contacts switching mechanism having at least two units arranged symmetrically in relation to said axis of said actuating element, each of said units consisting of a lever and a spring having outer ends which are remote from said axis of said actuating element, interconnected at connection points in a manner providing for their reciprocal angular movement, like elements of said units each having inner ends having a distance from said axis of said actuating element less than the distance of the outer ends therefrom connected to said actuating element for angular movement relative thereto, other inner ends of like elements of the units carrying said movable contacts being interconnected in a manner providing for their angular movement, limiters for restricting displacement of the connection points of said lever to said spring, wherein said contacts switching mechanism on which said movable contacts (3) are secured in a central portion thereof is secured so that said resilient part (12), at the portions between attachment points thereon of said movable contacts (13) and its outer ends (15), defines resilient elements (9) positioned symmetrically relative to said axis of said drive member (4) at an angle to each other in any possible position of said drive member (4), whereas the attachment points of said movable contacts (3) on said resilient part (12) are arranged between stop elements (17) at equal distances therefrom, said integral resilient part of said mechanism for switching said movable contacts being a frame, said movable contacts being secured in said central portion of each side thereof.

4. A microswitch according to claim 3 wherein said switching mechanism is fashioned as an integral resilient part (66).

5. A microswitch comprising a base; fixed contacts secured on said base; contact holders movably secured on said base and disposed symmetrically relative to said fixed contacts; movable contacts secured to said contact holders and operable with said fixed contacts; an actuating element comprising a drive member having an operative axis connected to the movable contacts by means of a movable contacts switching mechanism having at least two units arranged symmetrically relative to said axis of said actuating element, each of said units consisting of a lever and a spring having outer ends which, being the most remote from said axis of said actuating element, are interconnected at connection points in a manner providing for their reciprocal angular movement, like elements of said units each having inner ends having a distance from said axis of said actuating element less than the distance of the outer ends therefrom connected to said actuating element for angular movement relative thereto, other inner ends of like elements of said units carrying said movable contacts interconnected in a manner providing for their angular movement; limiters provided on said base for restricting displacement of the connection points of said lever to said spring, characterized in that said contacts switching mechanism is connected at its central portion to said contact holder (72) by means of attachment elements (86) provided on at least one of such parts (72,85) so that said resilient part (85) at the portions between the connection points thereof with said contact holder (72) and its outer ends (90) defines resilient elements (81) disposed symmetrically relative to said axis of said drive member (76) at an angle to each other in any position of the drive member (76), the connection points of said resilient part (85) with the contact holder (72) being disposed between said stop elements (91) at equal distances therefrom, said resilient part of said mechanism for switching said movable contacts being a frame, said contact holder being secured in said central portion of each thereof, said movable contacts being secured on a contact bridge which in turn is attached to said contact holder by means of said spring to be capable of self adjustment, said central part of said frame being provided with projections cooperating with slots of said contact holder.

* * * * *